US005125869A

United States Patent [19]

VonSick

[11] Patent Number: 5,125,869

[45] Date of Patent: Jun. 30, 1992

[54] SPRING BIASED CHIMNEY DAMPER

[76] Inventor: Hal A. VonSick, 912 Southview Rd., Louisville, Ky. 40214

[21] Appl. No.: 706,941

[22] Filed: May 29, 1991

Related U.S. Application Data

[63] Continuation of Ser. No. 471,265, Jan. 26, 1990, abandoned.

[51] Int. Cl.[5] ..... F23L 17/10

[52] U.S. Cl. ..... 454/4; 454/29; 126/286

[58] Field of Search ..... 454/4, 5, 7, 29; 126/286

[56] References Cited

U.S. PATENT DOCUMENTS

| | | | |
|---|---|---|---|
| 1,720,789 | 7/1929 | Heusser | 454/5 X |
| 2,856,839 | 10/1958 | Soderberg | 454/7 |
| 3,101,039 | 8/1963 | Duchene et al. | 454/4 |
| 3,267,832 | 8/1966 | Hinkle | 454/4 |
| 3,377,939 | 4/1968 | Sailors | 454/7 |
| 3,730,112 | 5/1973 | Hutchinson et al. | 454/4 |
| 3,945,307 | 3/1976 | Lyemance | 454/7 |
| 4,007,730 | 2/1977 | Heebink | 454/42 |
| 4,020,754 | 5/0977 | Dalsin et al. | 454/4 |
| 4,165,679 | 8/1979 | Lyemance | 454/7 |
| 4,181,119 | 1/1980 | Lyles | 454/4 |
| 4,256,257 | 3/1981 | Pinkerton | 454/4 |
| 4,368,663 | 1/1983 | Tabacco | 454/7 |
| 4,528,897 | 7/1985 | Homolik | 454/7 |
| 4,554,863 | 11/1985 | Dalsin | 454/4 |

FOREIGN PATENT DOCUMENTS 1344498 1/1971 United Kingdom .

*Primary Examiner*—Harold Joyce
*Attorney, Agent, or Firm*—Theresa Fritz Camoriano

[57] ABSTRACT

A chimney cap to selectively cover the outlet from the flue of a chimney which includes an open frame of selected geometric configuration located at the top of the chimney flue around the outlet, a cap to substantially cover the opening defined by the frame, bias device to bias the cap to a position separated by the frame, where a seal is provided to seal the cap and the frame when the cap is located contiguous to the frame. A guide arrangement can be provided to guide the cap toward the frame to selectively locate the seal of the cap and seal surface of the frame. A draw device can be provided to pass through the chimney flue to allow the cap to be drawn to engagement with the frame and a latch can be provided to receive the draw device to hold the cap in engagement with the frame against the bias force.

7 Claims, 2 Drawing Sheets

SPRING BIASED CHIMNEY DAMPER

This is a continuation of application Ser. No. 07/471,265, filed Jan. 26, 1990 abandoned.

BACKGROUND OF THE INVENTION

The prior art recognizes the problems associated with the use of a chimney and in particular with the use of a chimney which connects with a fireplace which opens into a habitable area. The problems are associated with rain, insects, animals, birds, that ofen enter a home or other building through an open chimney when the associated fireplace is not in use.

Another problem is that heat is lost through an open chimney during the winter months when the fireplace is not in use. In some some instances an internal damper system is provided to close off the chimney from the inside when the fireplace is not in used to prevent heat loss but internal dampers do not exclude either rain, animals, or birds, from the balance of the chimney. Thus if an animal is located in a chimney which is provided with an internal damper, and the internal damper is opened in order to start a fire in the associated fireplace, then the animal has an opportunity to enter the living area.

The prior art shows various means for closing a chimney or flue when it is not in use. Some prior arrangements are shown in the U.S. Pat. No. 3,945,307 Lyemance; U.S. Pat. No. 2,704,502 Rainey; U.S. Pat. No. 2,856,839 Soderberg; as well as U.S. Pat. No. 3,276,832 Hinkle; and U.S. Pat. No. 377,939 Sailors. The present invention provides a chimney cap arrangement which allows selective closure of the flue outlet from a chimney by use of a biased cap where the cap is received on a frame and seal means are provided between the cap and the frame so that when the cap is drawn downwardly the cap and the frame provide a close to prevent access by animals birds, or even rain. A bias arrangement such as spring arrangement is provided to urge the cap upwardly away from the frame and a draw means such as a chain or cord is provided to allow the cap to be drawn into engagement with the frame from the associated fireplace. The bias means can include a spring which can be arranged as described hereinafter to prevent access to the chimney by larger animals or birds even when the cap is open without restricting the draw of the chimney.

Devices within the scope of the present invention have been found to be highly effective and are relatively inexpensive inasmuch as the features of the present invention permit inexpensive fabrication of the associated parts. Arrangements within the scope of the present invention are also extremely effective in preventing the entry of windblown water.

The prior art recognizes the problems associated with the use of chimney caps particularly in very cold wet weather where there is some likelihood that the cap would freeze onto an associated frame. Devices in accordance with the present invention also provide a hammer arrangement which supplies more than adequate force necessary to break the cap away from the frame in the event ice is formed between the cap and the frame.

Another feature in accordance with the present invention provides a seal arrangement which minimizes the likelihood of the formation of ice between the cap and the frame but even where such ice does form the formation of the ice is minimized to facilitate the release of the cap from the frame.

More particularly, the present invention provides a chimney cap to selectively cover the outlet from the flue of a chimney which includes an open frame of selected geometric configuration located at the top of the chimney flue around the outlet, a cap to substantially cover the opening defined by the frame, bias device to bias the cap to a position separated from the frame, where a seal is provided to seal the cap and the frame when the cap is located contiguous to the frame. A guide arrangement can be provided to guide the cap toward the frame to selectively locate the seal of the cap and the seal surface of the frame. A draw device can be provided to pass through the chimney flue to allow the cap to be drawn to engagement with the frame and a latch can be provided to receive the draw means to hold the cap in engagement with the frame against the bias force.

Examples within the scope of the present invention are illustrated in the accompanying drawings and described hereinafter but it will be understood that the examples shown and described herein are by way of example only and not by way of limitation.

BRIEF DESCRIPTION OF THE DRAWINGS

Examples of arrangements within the scope of the present invention shown in the accompanying drawings and described hereinafter.

DETAILED DESCRIPTION OF THE DRAWINGS

Figure 1:
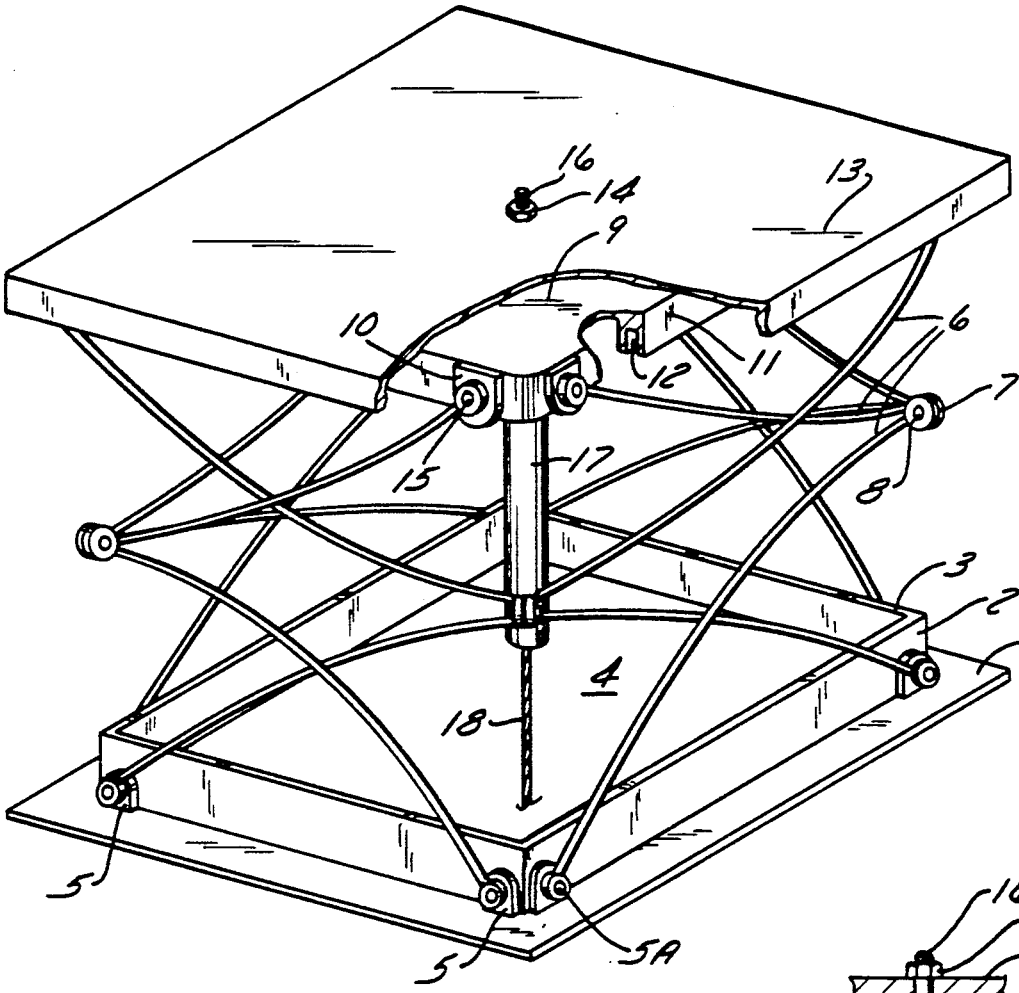
FIG. 1 is a perspective view partially in section, of one example of an arrangement within the scope of the present invention.

Referring first to FIG. 1, a perspective illustration is shown partially in section of an arrangement within the scope of the present invention, having an upstanding wall 2 with an upper edge 3 defining an opening 4 which, as discussed hereinafter, is provided to surround the flue of a chimney. Frame 1 can be rectangular in shape as shown or within the scope of the present invention can be of any other useful configuration depending upon the particular application for which the device is to be used. Bosses 5 are provided on the wall 2, as shown and adapted to receive bolts 5A which retain one end of spring wire 6 as shown, the opposite end of each of the springs 6 is connected to another cooperative spring 6 by means of a fastener 8 where washers 7 are provided to maintain the loops provided at the end of the springs for fastening purposes. The opposite ends of these springs are then attached to bosses 10 of an upper frame 9 by means of fasteners 15. Springs 6 form a cooperative, generally maintenance bias arrangement to hold the upper frame 9 outwardly from the frame 1, as shown. While other spring or bias arrangements can be provided within the scope of the present invention, the arrangement shown has been found to be particularly useful in as much as when the devices are located on a chimney in open condition, entry of birds and other larger animals is discouraged by the cage formed by the springs 6 located around the perimeter of the flue on the other hand the springs provide a suitable, and highly uniform bias arrangement. Further, the failure of one of the spring elements does not prevent the use of the apparatus; and replacement of springs is quite simple.

The upper frame 9, as previously mentioned, carries the bosses 10 and has a channel shaped edge where walls 11 are provided defining a channel 12 therebetween. Advantageously, the width of the channel 12 is adapted to receive the upper edge 3 of the wall 2 of the frame 1 to form a seal to prevent escape of air and/or entry of blowing rain. Additionally, channel 12 can be lined with a material such as silicone which is not adherent to ice or other substances to facilitate release of the cap assembly, when in cold and rainy weather there may be a tendency for the cap to freeze in the closed position. The bosses 10 on the upper frame 9 are located outside of the walls 11, and the bosses 5 on the lower frame 1 are located outside the upstanding wall 2, so that the biasing springs 6 are mounted at points around the perimeter of the flue which are outside of the seal formed between the channel 12 and the upper edge 3.

Additionally, a hammer assembly 17 is provided secured through the upper frame 9 and the cap 13 by means of a bolt 16 which extends through the sheath provided for the hammer assembly and secured by means of a nut 14 as shown.

Figure 2:
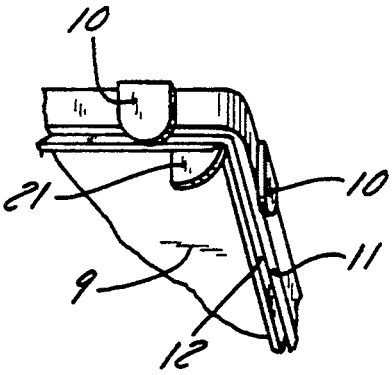
FIG. 2 is an enlarged view of an example of the seal arrangement utilized in the example shown in FIG. 1.

FIG. 2 illustrates another feature of the upper cap 9 where the walls 11 are shown defining the channel 12. Also the bosses 10 are shown but a guide member 21 is also illustrated where it will be understood that there can be 4 of the guide members one at each corner of the upper frame 9 to guide channel 12 of the upper frame 9 into upper edge 3 of the wall member 2.

Also it will be understood that within the scope of the present invention the tongue and groove seal formed by the channel 12 and the upper edge 3 of the wall 2 can be reversed. That is, the channel could be on the lower segment of the lower frame and the tongue section which would be the equivalent of the upper edge 3 of wall 2 provided on the top.

Figure 3:
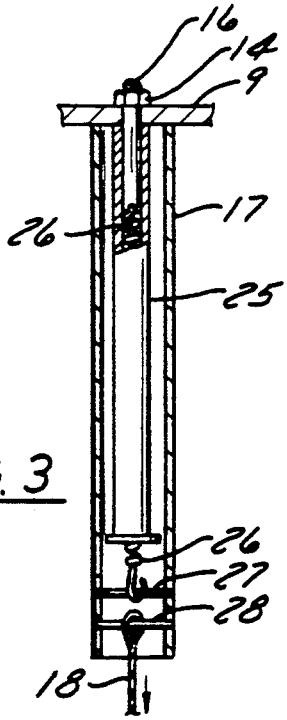
FIG. 3 is a cross section view of a hammer arrangement which can be utilized in arrangements of the type shown in FIG. 1.

FIG. 3 as previously stated is a cross sectional illustration of one example of a hammer within the scope of the present invention where a spring 26 is provided within a tube 25 with a rod 16 extending downwardly through sheath 25 which acts as a hammer and where the spring is connected to the sheath 25. A line 18 which is also shown in FIG. 1 is connected to the bottom of the sheath 25 so as the line 18 is pulled the sheath 25 is pulled downwardly and stretches the spring 26. Upon release of the line 18 the hammer 17 travels upwardly and strikes the underside of the top frame 9 thereby providing a sharp impact which releases the upper cap assembly 13 from the wall 2 in the event there is ice or other material present. Alternatively, the spring 26 provides tension to provide a hold down for cap 13 as described with reference to FIGS. 4 and 4A.

Figure 4A:
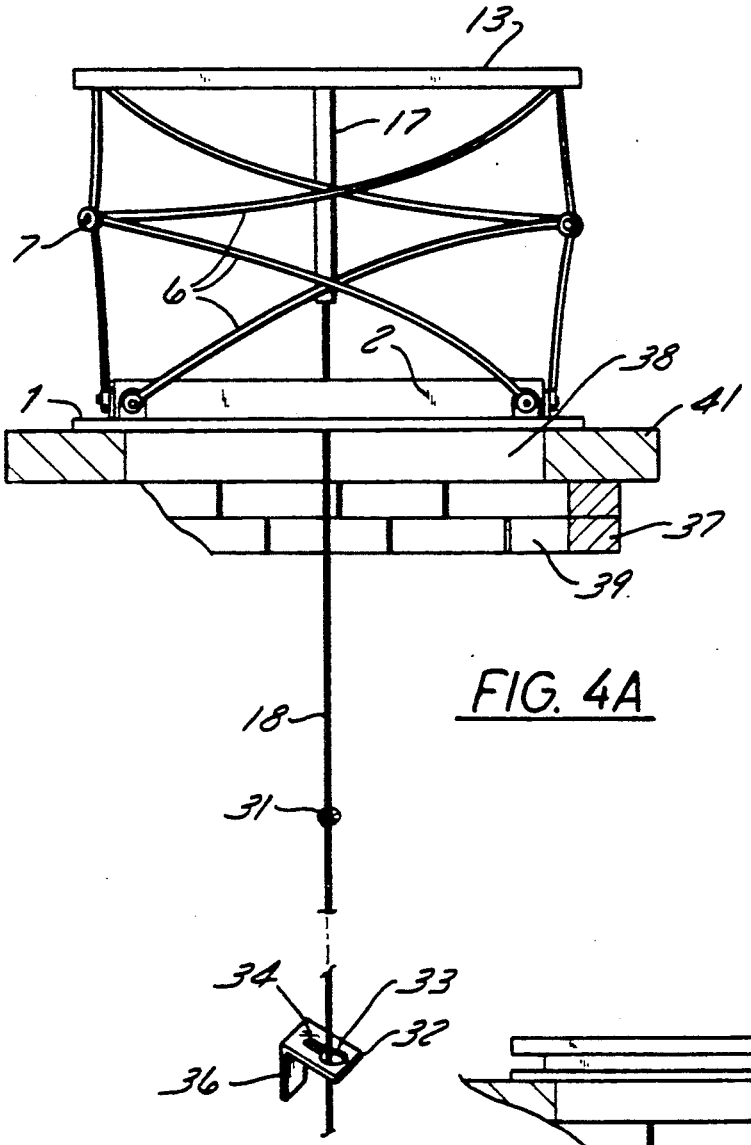
FIGS. 4A and 4B are sequential examples illustrating operation of the device of the type shown in FIG. 1.

In FIG. 4A the cross sectional view of the assembly shown in FIG. 1 is provided where line 18 is extended downwardly through a flue 39 defined by a chimney 37. The frame 1 as shown, is located on the cap stone of a chimney surrounding the perimeter of the chimney's flue. The frame can be retained by any convenient means including the use of adhesives as well as fastening devices such as bolts and screws.

In the arrangement shown the cap 13 is in the up position so that the flue is open for emission of smoke and products of combustion. Line 18 includes an enlargement 31 and extends through an opening 33 of a bracket 32. A bracket 32 can be fastened to the side of a chimney by means of foot 36 as shown. A groove 34 can be provided to act as a retainer as described with reference to FIG. 4B.

Figure 4B:
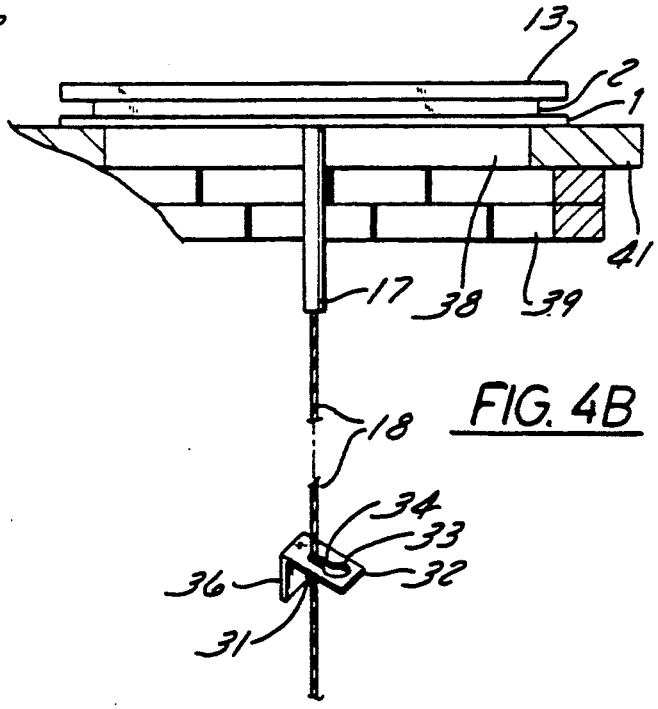

In FIG. 4B the cap 13 is shown in the withdrawn position to close the flue 39 where the line 18 has been pulled down and the enlarged section, (a ball or even a knot) is drawn through the opening 33 with line 18 moved back into the slot 34 so that the upper side of the enlargement 31 engages the underside of the bracket 32. Thus, the cap is retained in the down position and the enlargement 31 can be located so that when the cap is in the closed position as shown in FIG. 4B the hammer 17 is slightly withdrawn from the underside of the cap so that spring tension is maintained to hold the cap in the down position.

It will be understood that the foregoing is but one example of an arrangement within the scope of the present invention and that other arrangements also within the scope of the present invention will occur to those skilled in art upon reading the disclosure set forth hereinbefore.

The invention claimed is:

1. A flue damper, comprising:

a lower frame, adapted to be located on the top surface of a chimney, surrounding the perimeter of the chimney's flue;

an upper frame, including a cap;

sealing means for sealing between said upper frame and said lower frame around the perimeter of the chimney's flue when said flue damper is closed; and bias means mounted to said upper frame and said lower frame at points outside of said sealing means for biasing said upper frame to a position separated from said lower frame, wherein said bias means is located under said cap when said flue damper is closed.

2. A flue damper as recited in claim 1, wherein said bias means includes a plurality of spring members, each of said spring members having a first end and a second end, with said first end being connected to one of said upper and lower frames and said second end being connected to the second end of one other of said spring members, the first end of said other spring member being connected to the other of said frames.

3. A flue damper as recited in claim 2, wherein each of said spring members is a spring wire.

4. A flue damper as recited in claim 1, including a guide to guide said upper frame into proper sealing engagement with said lower frame as said upper frame is moved toward said lower frame.

5. A flue damper as recited in claim 1, including draw means connected at one end to said upper frame and projecting downward, for drawing said upper frame into sealing engagement with said lower frame, and further including hammer means for striking said upper frame.

6. A flue damper as recited in claim 1, wherein said sealing means includes an upwardly-projecting wall on said lower frame extending around the perimeter of the flue, and a first downwardly-projecting wall on said upper frame, which, when said damper is closed, extends around the perimeter of the flue inside said upwardly-projecting wall.

7. A flue damper as recited in claim 6, and further comprising a second downwardly-projecting wall on said upper frame, which, when said damper is closed, extends around the perimeter of the outside of said upwardly-projecting wall, such that a channel is formed between said first and second downwardly-projecting walls, and said channel receives said upwardly-projecting wall.

* * * * *